United States Patent [19]

Hehl

[11] Patent Number: 4,558,916

[45] Date of Patent: Dec. 17, 1985

[54] MULTI-PIN PLUG CONNECTION SYSTEM FOR ELECTRONIC CONTROL UNIT

[76] Inventor: Karl Hehl, Arthur-Hehl-Strasse 32, 7298 Lossburg 1, Fed. Rep. of Germany

[21] Appl. No.: 537,174

[22] Filed: Sep. 29, 1983

[30] Foreign Application Priority Data

Sep. 29, 1982 [DE] Fed. Rep. of Germany ..... 3235950
Apr. 29, 1983 [DE] Fed. Rep. of Germany ..... 3315688

[51] Int. Cl.[4] ..... H01R 23/66; H01R 13/506

[52] U.S. Cl. ..... 339/107; 339/126 R; 339/176 MF; 339/186 M; 339/206 R

[58] Field of Search ..... 339/63 R, 63 M, 103 M, 339/107, 105, 91 R, 99 R, 196 M, 206 R, 206 P, 208, 138, 141, 126 R, 126 RS, 186 M, 176 MF

[56] References Cited

U.S. PATENT DOCUMENTS

| | | | |
|---|---|---|---|
| 3,569,914 | 3/1971 | Taylor et al. | 339/107 |
| 3,760,336 | 9/1973 | Cerwin | 339/138 |
| 4,062,611 | 12/1977 | Carlsson et al. | 339/17 M |
| 4,105,275 | 8/1978 | Dixon et al. | 339/91 R |
| 4,209,219 | 6/1980 | Proietto | 339/99 R |
| 4,225,205 | 9/1980 | Sinclair et al. | 339/103 M |
| 4,343,528 | 8/1982 | Lucius et al. | 339/206 R |
| 4,457,576 | 7/1984 | Cosmos et al. | 339/141 |

FOREIGN PATENT DOCUMENTS

| | | | |
|---|---|---|---|
| 2053213 | 5/1972 | Fed. Rep. of Germany | 339/107 |

*Primary Examiner*—Neil Abrams
*Attorney, Agent, or Firm*—Joseph A. Geiger

[57] ABSTRACT

A multi-pin plug connection system with a multi-pin plug connector accepting single or multiple unequally constituted multi-conductor cables of the round and/or ribbon type for connection to the standardized socket bars of printed circuit board modules, the multi-pin connector featuring a one-piece housing with a central pocket receiving a pin bar assembly composed of one or more plug units. Each plug unit holds a number of parallel conductor strands, which enter positioning grooves between two clamping members from one or the other direction, in engagement with contact knives of the contact posts. The connector housing has two shell halves attached to the sides of said pocket by a bending hinge and equipped with cable positioning and reorienting studs in alignment with a shaped entry aperture, the shell halves being pivotable from an injection-molded open position to an abutting closed position.

23 Claims, 48 Drawing Figures

23
15e
15b
15
20y
20b'
20a
14h
15k
15h
36
35
34
22
34a
15m
10a
37
15a
13b
31
13
12
13a
38
15f
22b
14b
14
14a
14c
15p
15g
E
f 15d
15c
f
0
15
15b
33
32
15k
15p
15h
15g
15m
15a
15f
14a
14
14b
f 15d
15e
15e'
15m
15f
15h
15a
15

15l
15b
15c
15e
15l
15e'
15e
K
15a
8
7
6
5
4
3
2
1
15f
15

MULTI-PIN PLUG CONNECTION SYSTEM FOR ELECTRONIC CONTROL UNIT

BACKGROUND OF THE INVENTION

1. Field of the Invention

The present invention relates to electrical multi-pin plug connections and, more particularly, to a multi-pin plug connection system with a multi-pin plug connector for the connection of single or multiple unequally constituted multi-conductor cables of the round and/or ribbon type to multi-terminal socket bars, particularly the standardized socket bars of the printed circuit board modules of an electronic control unit.

2. Description of the Prior Art

Recent years have seen a great increase in the use of multi-conductor electronic transmission cables with multi-pin plug connectors, not only in the field of data processing hardware, but also in connection with modern industrial production machines, due to a very rapid growth in the volume of electronic data and electronic control signals which need to be transmitted between the control center of the production machine and the various points of control input and output on the machine.

Facilitating and forcing this trend is the realization that a centralization of the electronic control functions of a production machine in a control center and the use of a control computer can bring with it decisive advantages in terms of a wider range of productive adaptation of the machine, as well as in terms of the ease with which the operational program of the machine can be adapted to changing production requirements.

This situation applies, for example, in the case of a modern injection molding machine, where the changeover from the production of a one part to the production of another part may involve changes in a large number of control parameters on the machine. The availability of prerecorded operating programs on interchangeable information carriers—magnetic tape cassettes, for example—reduces the changeover from one operational program to another to a problem-free routine task.

On the other hand, a production machine of this kind will require rather complex electronic circuitry which, if malfunction occurs, may be difficult to service and to repair. The complexity of such servicing and repair work can be greatly reduced, however, through the application of the building-block principle to the electronic control center, by using removable, readily exchangeable electronic circuitry modules with pluggable connections which may form part of a data bus, for example.

While it is relatively easy to standardize the connections between the various electronic circuitry modules at the data bus on the back panel of the control center, it is generally not possible to similarly standardize the plug connections for the connecting cables which lead from the control center to the various points of control input and output of the production machine. The particular machine configuration may necessitate the use of an assortment of different cables, from round cables with only a few conductors to ribbon cables with several dozens of parallel conductors in a single cable.

A variety of different multi-pin plug connectors, adapted to the multi-conductor cables in terms of type and size, are employed in a plug connection system which is known from the advertising brochure "Das Berg Backpanel-System" of Du Pont de Nemours GmbH, Max-Plank-Str. 11, in 6047 Dietzenbach, Germany.

In the past, therefore, the various multi-conductor cables had different multi-pin plug connections at the back panel of the control center. The absence of uniformity in these connections reflects itself in correspondingly high production costs and in more difficult assembly operations, as well as in considerable space requirements, when a plurality of different multi-conductor cables have to have pluggable connections at the same circuit board module.

SUMMARY OF THE INVENTION

Underlying the present invention is the primary objective of suggesting an improved multi-pin plug connection system with a multi-pin plug connector which permits a maximum degree of standardization of the pluggable electronic cable connections at the back panel of an electronic circuitry cabinet by serving as a plug terminal for single or multiple unequally constituted multi-conductor cables of the round type or of the ribbon-type, or a combination of cables of both types, and by presenting a compact standardized connector structure with easily assemblable components.

The present invention proposes to attain this objective by suggesting a plug connection system for the connection of the circuit board modules of an electronic control unit to the multi-conductor cables which lead to a production machine which is characterized by a plurality of fractional-length plug units which are combinable to form a standardized contact bar assembly in the plug connector, which assembly is engageable into receiving walls in the form of a pocket between two shell halves of the plug connector housing, whereby the plug units have clamping members with cooperating groove beds, and either ribbon cables or parallel oriented conductor strands of round cables are selectively clampable between positioning grooves of the groove beds.

In a preferred embodiment of the invention, the housing of the plug connector is a one-piece injection-molded part, the shell halves of the plug connector being attached to the central housing pocket by means of two bending hinges. In the open, injection-molded state, the plug units and their attached round or ribbon-type cables are insertable into the housing pocket and the round cables are positionable between rows of studs in the two shell halves in such a way that 90°-reorientation bends are obtained.

As the shell halves are pivoted against each other, they engage the inserted plug units from behind with a retaining shoulder to secure them inside the housing pocket. At the same time, the shell halves close against each other in a snap action, forming a cable entry aperture on one longitudinal extremity for the round and/or ribbon cables.

The subdivision of the pin bar assembly into a plurality of plug units makes it easier to assemble the plug connector and to locate connection defects or errors, if necessary. The combination of different multi-conductor cables in a single pluggable assembly is more compact than a comparable arrangement of separate plug connectors.

The standardized plug units are so designed that they require neither assembly tools nor fasteners: The inner and outer clamping members are attachable to the ends of the conductor strands of round or ribbon-type cables in a snap-action operation, and a contact post housing with two rows of metallic contact posts is insertable through the attached clamping members, until locked in place in another snap action, thereby establishing electrical contact between the conductors and special dual knife ends of the contact posts.

The preferred embodiment further suggests the arrangement of a code clip on the outside wall of the central pocket of the connector housing, in one of a number of different locations, and the provision of an insertion aperture in the back panel of the control unit with a correspondingly located code recess.

As an alternative solution, a modified embodiment of the invention features an adapter frame with a code flange for each plug connector. The adapter frame is clamped to the socket bar at the edge of a circuit board module to take the place of the back panel of the circuitry cabinet of the electronic control unit.

BRIEF DESCRIPTION OF THE DRAWINGS

Further special features and advantages of the invention will become apparent from the description following below, when taken together with the accompanying drawings which illustrate, by way of example, preferred embodiments of the invention represented in the various figures as follows.

DESCRIPTION OF THE PREFERRED EMBODIMENTS

Figure 1:
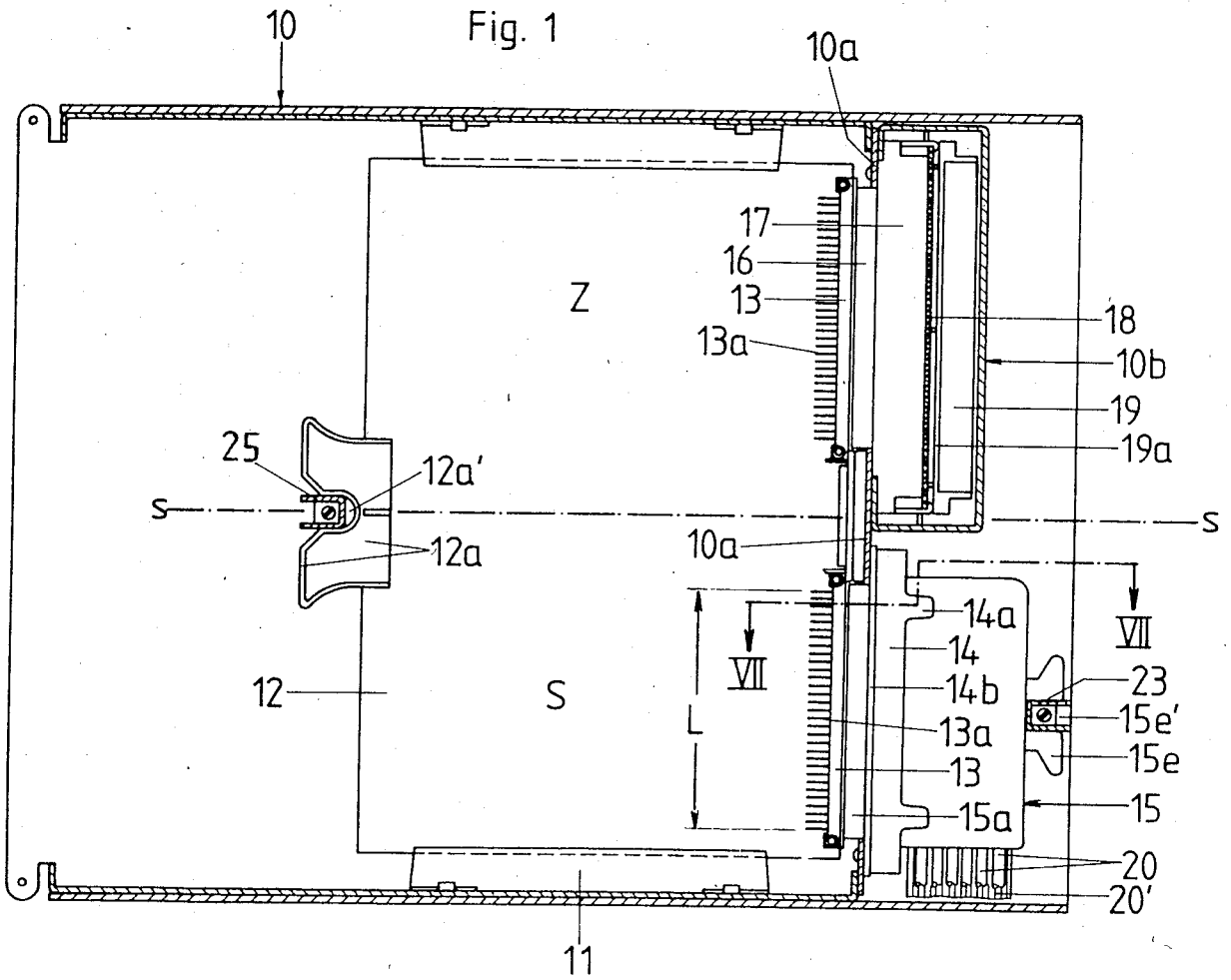
FIG. 1 shows, in a vertical transverse cross section, a circuitry cabinet of an electronic control center of a production machine with a typical pluggable circuit board module.

FIG. 1 shows, as part of an electronic control center for a production machine, a circuitry cabinet 10 enclosing a number of parallel spaced circuit board modules 12 in the form of printed circuit boards which carry various electronic components. The circuit board modules 12 are positioned and guided on opposite sides by module guides 11 at the upper and lower cabinet walls 10. A positioning rail 25 in the center plane s-s of the circuitry cabinet engages a centering recess 12*a*′ of a handle 12*a* on each module, thereby providing an accurate alignment of the circuit board modules within the cabinet 10.

Each circuit board module 12 has on its rear edge a pluggable multi-conductor connection, the connections above the center plane s-s being part of a data bus 18, and the connections below the plane s-s being the end points of a plurality of multi-conductor cables 20 and 20*a* which lead from the electronic control center to the various operating units of the production machine, where control input and data output take place. The multi-pin plug connectors receiving the extremities of variously constituted cables 20 and 20′ are the subject of the present invention and will be described in detail further below.

The data bus 18 serves to interconnect the various circuit board modules 12. A typical data bus connection is shown at an enlarged scale in FIG. 6. It consists essentially of a socket bar 13 on the vertical edge of the printed circuit module 12 into which are engaged the contact pins 16*b* of a pin bar 16. The latter is carried by and electrically connected to the data bus 18 on the outer side of the back panel 10*a* of the circuitry cabinet 10.

The back panel 10*a* has rectangular apertures for the pin bar 16, and the latter has shoulders positioning it against the back panel 10, through the intermediary of a centering member 17 which is clamped to the outer side of the back panel 10*a* by means of screws 24. The centering member 17 determines the position of the data bus 18 by means of positioning faces 17*c* and a plurality of flexible retaining noses 17*a* engaging the edges of the data bus 18.

The data bus 18 is secured and stiffened by means of several data bus platens 19 which snap onto the edges of the data bus 18 through the action of flexible platen retaining noses 19*b*. The data bus platen 19 has a platen wall 19*a* extending parallel to the data bus 18 and bearing against the latter with spacer ribs 19*c* located between the conductors of the data bus, thereby stiffening the data bus 18. Enclosing the entire data bus assembly is a data bus cover 10*b*.

Figures 7, 8, 9:
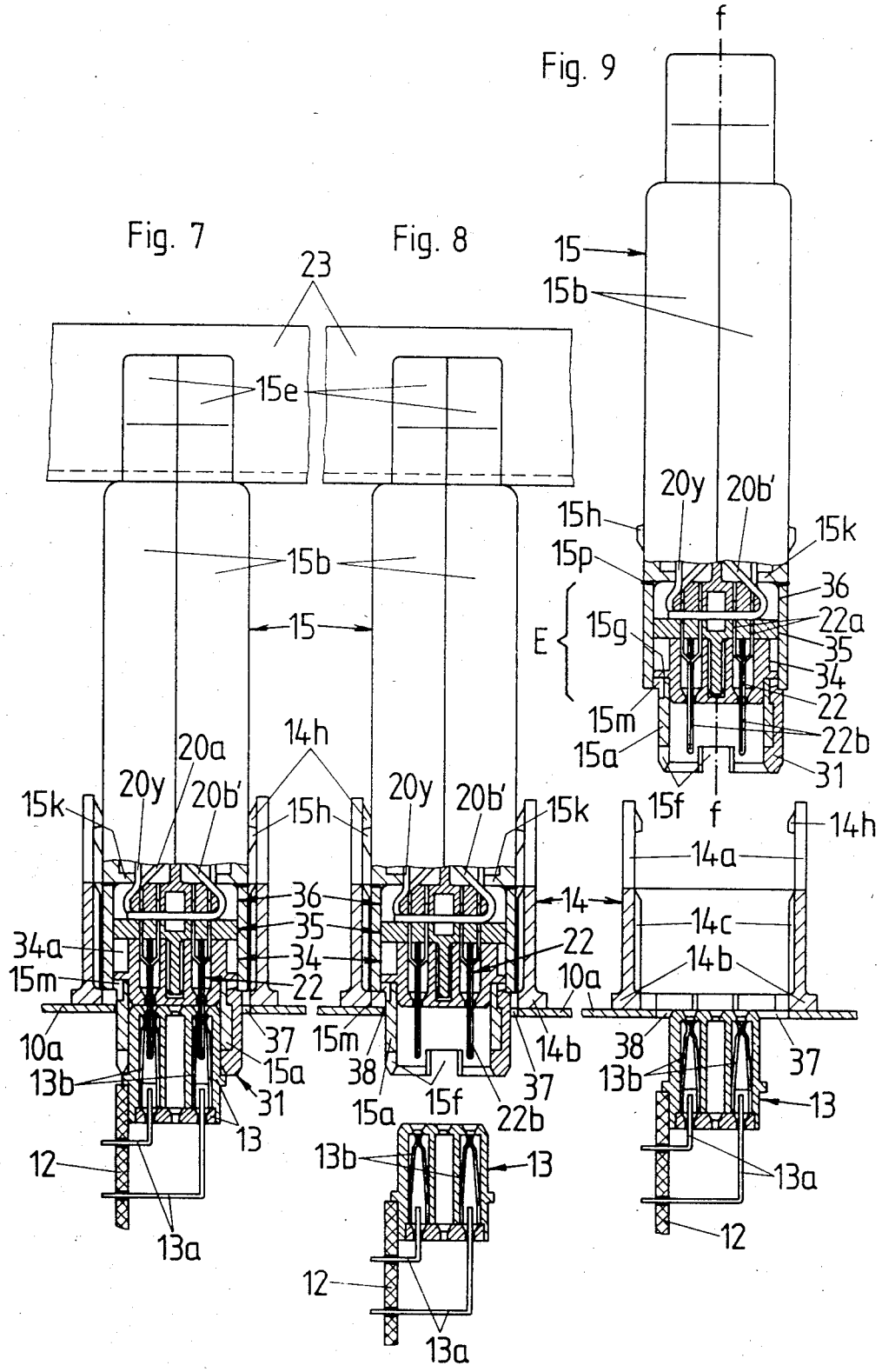
FIG. 7 shows the multi-pin plug connector of the invention in a further enlarged elevational side view, partially cross-sectioned along line VII—VII of FIG. 1.
FIG. 8 is similar to FIG. 7, showing the end portion of a circuit board module in a retracted position.
FIG. 9 is similar to FIGS. 7 and 8, showing the multi-pin plug connector in a retracted position.

The contact sockets 13*b* of the socket bar 13 are electrically connected to the printed conductors of the circuit board module 12 by means of a series of angled solder pins 13*a*, the extremities of the latter being soldered to the interior end portions of the contact sockets 13*b*, as can be seen in FIG. 9.

Identical socket bars 13 are arranged on the lower side of each circuit board module 12, where they are engageable by the multi-pin plug connectors of the invention. All the socket bars 13*a* are so positioned in relation to the back panel 10*a* that their outer faces are approximately flush with the latter (FIG. 9). The socket bars 13 have two rows of contact sockets 13*b* of standardized dimensions and spacing.

Following is a description of a multi-pin plug connector which is engageable into a socket bar 13 and which is adapted for attachment to the extremities of a variety of multi-conductor cables, both of the round type and of the ribbon type, whereby the cables may be single or multiple cables. Additionally, the same plug connector is also adapted for attachment to a combination of both round and ribbon-type multi-conductor cables.

In alignment with the lower socket bars 13 of the circuit board modules 12, the back panel 10*a* of the electronic circuitry cabinet 10 has a row of generally rectangular apertures 38 (FIGS. 9 and 48) through which a leading portion of the plug connector can reach into engagement with the socket bar 13. As can be seen in FIGS. 7 through 9, the contact pins 22*b* of the plug connector thereby penetrate the contact sockets 13*b* of the socket bar.

Figure 6:
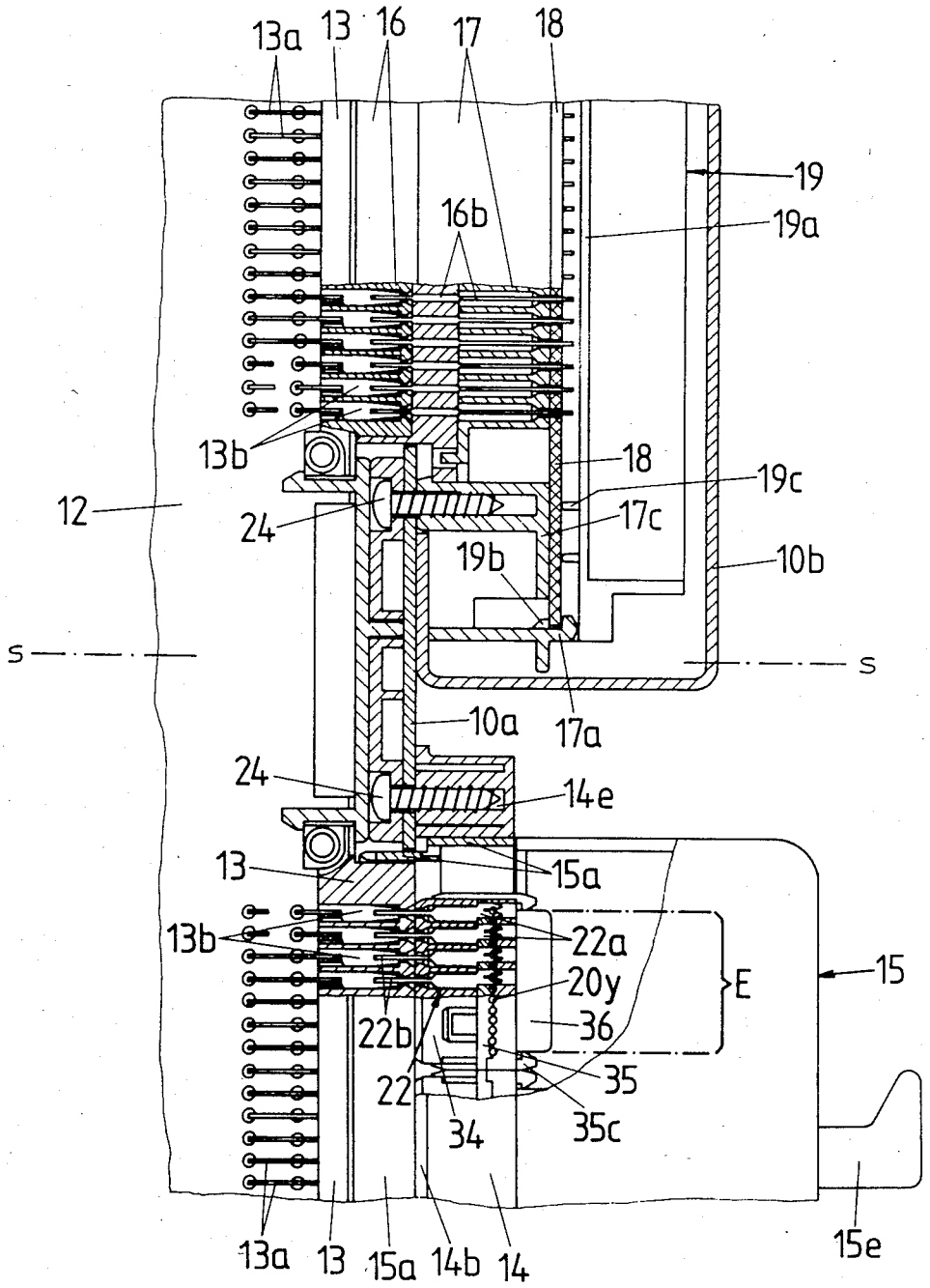
FIG. 6 shows, as part of another enlarged detail of FIG. 1, portions of a data bus and of the multi-pin plug connector of the invention.
Figure 10:
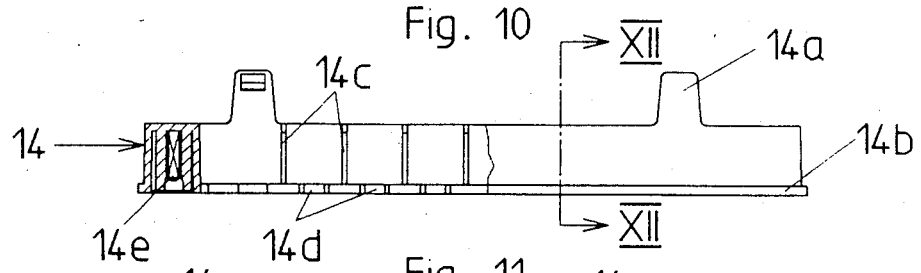
FIG. 10 shows, in an elevational front view, a positioning frame for the multi-pin plug connector of the invention.
Figure 11:
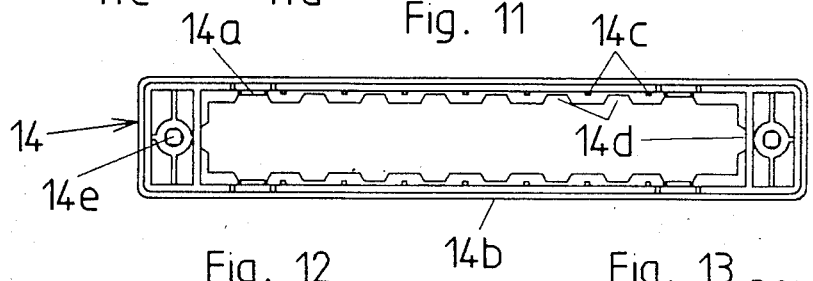
FIG. 11 shows the positioning frame of FIG. 10 in a plan view.
Figure 12:
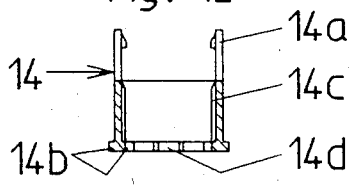
FIG. 12 shows the positioning frame of FIGS. 10 and 11 in a transverse cross section, taken along line XII—XII of FIG. 1.
Figure 13:
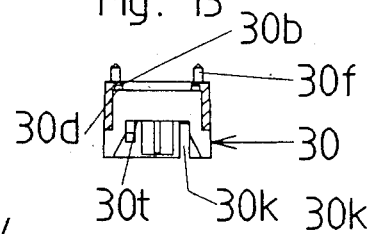
FIG. 13 is a transverse cross section of an adapter frame, taken along line XIII—XIII of FIG. 16.

Guiding the plug connector during its engagement with the socket bar 13 is a socket frame 14 which, in the engaged position, produces an detent-type retaining action between its flexible retaining tongues 14*a* and the housing of the plug connector. The socket frame 14, which will be described in greater detail in connection with FIGS. 10 through 12, is attached to the outer side of the back panel 10*a*, bearing against the latter with a base flange 14*b*. Screws 24 provide the attachment (FIG. 6). A series of guide ridges 14*c* on the inner periphery of the socket frame 14 serve to guide the plug connector.

The major structural component of the multi-pin plug connector is a housing 15 which is injection-molded of a resilient high-polymer plastic. The connector housing 15 consists essentially of a hollow rectangular housing pocket 15*a* to the longitudinal upper edges of which are integrally attached two outwardly rectangular shell halves. The connection between the central housing pocket 15*a* and the two shell halves of the housing 15 is in the form of two bending hinges 15*p*.

In its original injection-molded state, the connector housing 15 has its shell halves oriented wing-like in a common plane, at right angles to the direction of plug engagement (FIGS. 27 and 29 through 31). In the course of assembling the plug connector, its shell halves are pivoted against each other until, in the closed position of the connector housing 15, the two shell halves close against each other in parallel alignment (FIGS. 1 through 9 and 17 through 20).

Figure 2:
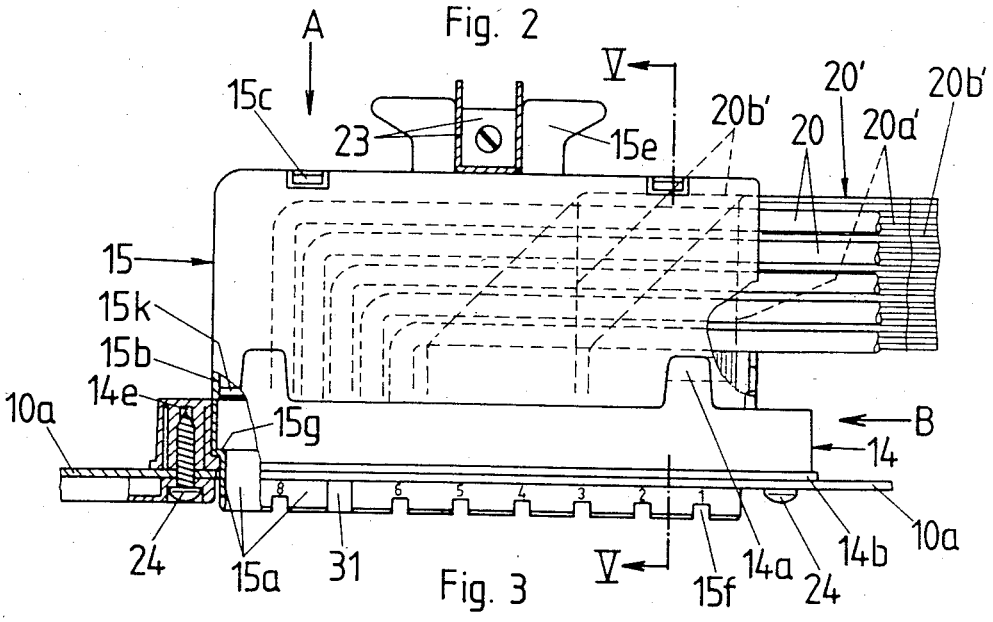
FIG. 2 shows, as part of an enlarged detail of FIG. 1, a multi-pin plug connector embodying the present invention.

The connector housing 15, when closed, forms a central joint line f-f along which the longitudinal end wall 15*b* of the shell halves touch. The longitudinal end walls 15*b* on one extremity of the housing 15 have recesses 32 and 33 accommodating therein a varied assortment of multi-conductor cables, for example, a number of round cables 20 and/or one or more ribbon cables 20'(FIGS. 1 and 2).

Figure 4:
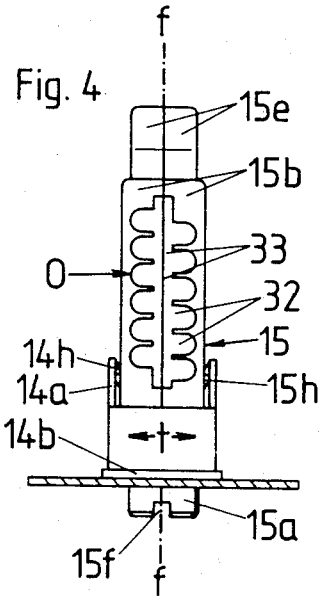
FIG. 4 shows the multi-pin plug connector of FIG. 2 in a side view in the direction of arrow B, without its multi-conductor cables.
Figure 17:
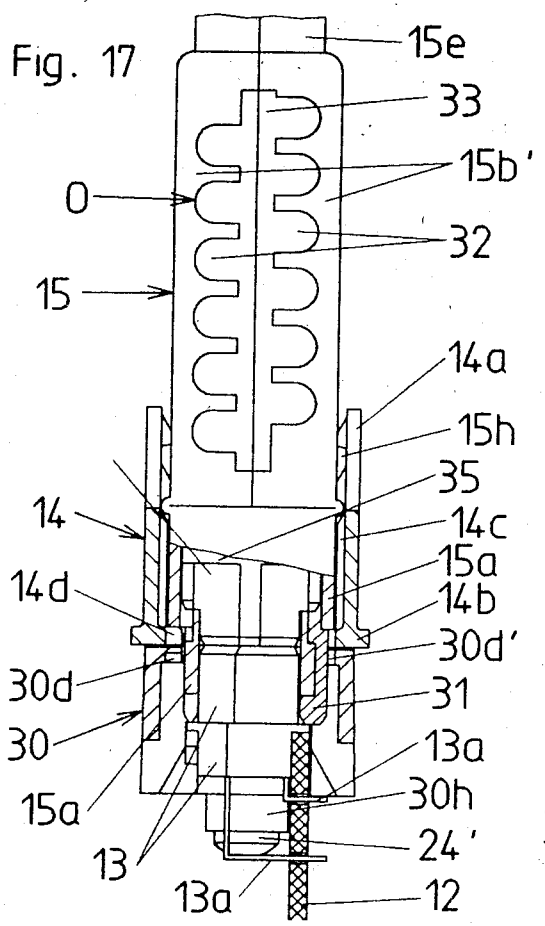
FIG. 17 is a partially cross-sectioned elevational end view of a modified multi-pin plug connector, using the adapter frame of FIGS. 13–16.
Figures 26, 27, 28:
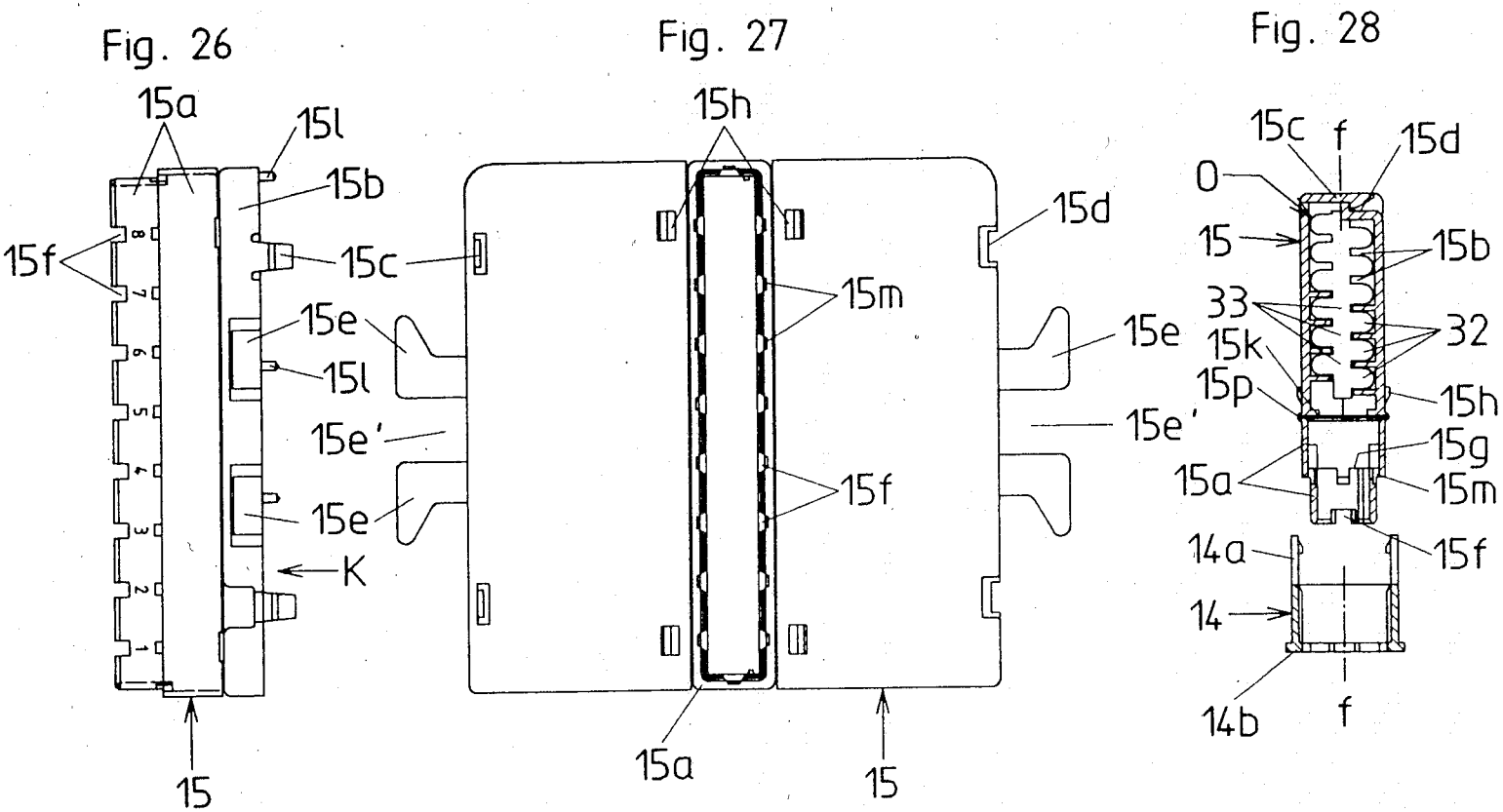
FIG. 26 shows, in a side view, the housing of the multi-pin plug connector in its injection-molded unfolded state.
FIG. 27 shows the connector housing of FIG. 26 in a plan view.
FIG. 28 shows the connector housing of FIGS. 26 and 27 in a closed position and transversely cross-sectioned.
Figure 29:
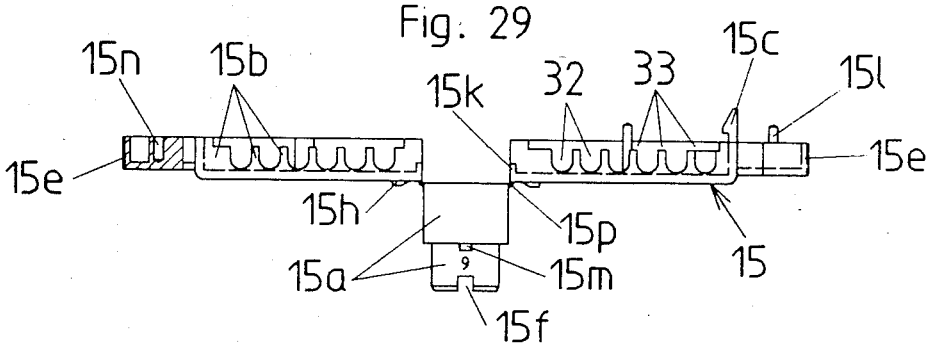
FIG. 29 shows the connector housing of FIGS. 26 and 27 in an elevational view, as seen in the direction of arrow H in FIG. 30.

The recesses 32 and 33 are open towards the joint line f-f, forming a single cable entry aperture O of bilaterally branched outline in the longitudinal end walls 15*b* (FIGS. 4, 17 and 28). The round cables 20 enter through six lobe-shaped recesses 32 in each housing half, the recesses in one housing half being offset against the recesses in the other housing half by one-half their spacing. The ribbon cables 20' enter through shallow recesses 33 which extend over the major portion of the length of the longitudinal end wall 15*b* and form a central rectangular entry slot at the joint line f-f.

In the embodiment shown in the drawing (e.g. FIG. 4), the total transverse depth of the cable entry aperture O is shown to be twice the diameter of a round cable 20 plus three times the thickness of a ribbon cable 20'. Accordingly, it is possible to connect up to three ribbon cables 20'. The presence of one or more such ribbon cables helps to retain the round cables 20 in their respective recesses 32. In the absence of a ribbon cable 20' in the central recesses 33, the round cables 20 are prevented from shifting into adjacent or opposite recesses 32 by stem-like residual portions of the opposite shell end wall 15*b* which are facing each recess 32, as a result of the earlier-mentioned offset between opposite recesses. The total transverse depth of the ribbon cable recesses 33 is less than the diameter of a round cable 20. The result is a compact, yet very adaptable, cable entry configuration at the shell end wall 15*b*.

The various multi-conductor cables 20 and 20' enter the connector housing 15 in a direction perpendicular to the direction of plug engagement. Therefore, all the cables need to be reoriented inside the housing 15 over an angle of 90°, into alignment with the direction of plug engagement. A wide ribbon cable 20' is preferably split into at least two cable strips 20*a'* and 20*b'* (FIG. 2).

Inside the connector housing 15, the cable strips are reoriented by offset diagonal cable folds which form transitions between the edge-to-edge reoriented cable end portions and the overlying cable strips 20*a'* and 20*b'* in the cable entry aperture O. The round cables 20 are simply bent over an angle of 90°, at appropriately staggered depths inside the connector housing 15, each cable 20 being separately held in place by a matrix of cable positioning studs 15*i* (see FIGS. 20 and 30).

The pocket 15*a* of the connector housing 15 holds two rows of contact pins 22*b* arranged to cooperate with the contact sockets 13*b* of the earlier-described socket bar 13 of a circuit board module 12 (FIG. 6). The contact pins 22*b* are part of a pin bar assembly which consists of either a single plug unit of a length matching the length of the housing pocket 15*a*, or two or more shorter plug units E (FIG. 20) having the same combined length.

All the plug units E have the same cross section. The lengths of the plug units E are preferably standardized in four sizes, so that either one, two, four, or eight identical plug units E make up a full-length pin bar assembly. Plug units of different length may be used to make up a pin bar assembly. For example, in FIG. 20 can be seen two plug units E of one-eighth length adjoined by a plug unit of one-quarter length.

Figure 30:
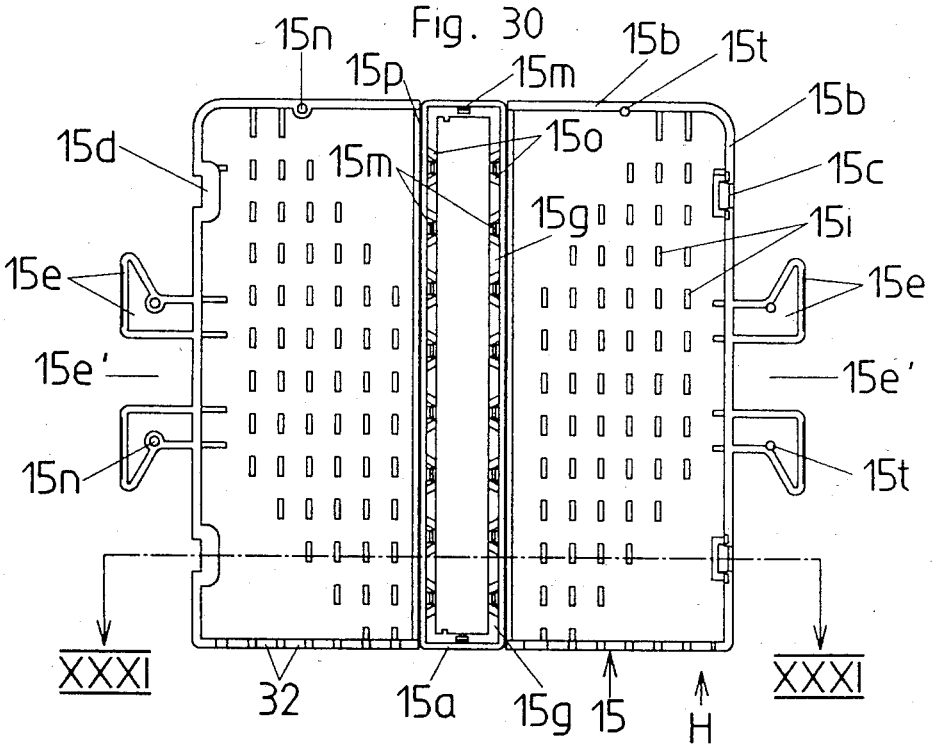
FIG. 30 shows the connector housing in a plan view, as seen in the direction of arrow K in FIG. 26.
Figure 36:
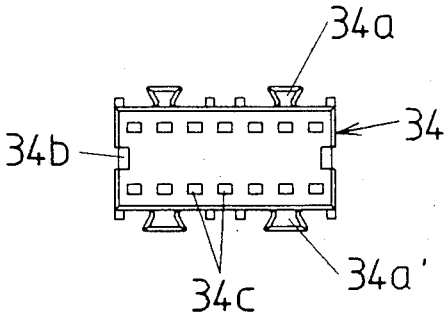
FIG. 36 shows the contact post housing of FIGS. 32–35 in a bottom plan view.
Figure 37:
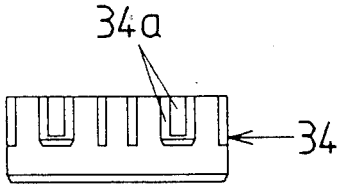
FIG. 37 is a frontal view of the contact post housing of FIGS. 32–36.
Figure 38:
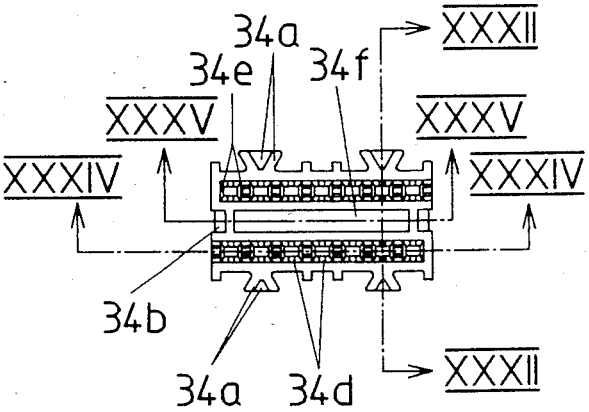
FIG. 38 shows the contact post housing of FIGS. 32–37 in a top plan view.
Figure 39:
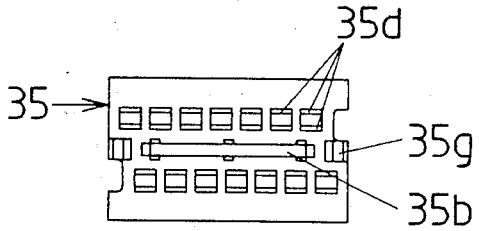
FIG. 39 shows, at a similarly enlarged scale and in a bottom plan view, an inner clamping member for a short plug unit of the multi-pin plug connector.

The pin bar assembly, consisting of one or more plug units E with attached conductors of the several multi-conductor cables 20 and/or 20', is inserted into the housing pocket 15*a*, when the housing 15 is in the open, unfolded state (FIG. 30). Inside the housing pocket 15*a*, the plug units E are guided and longitudinally positioned by means of dovetail guides, consisting of a series of dovetail grooves 15*o* (FIG. 30) on the inner longitudinal sides of the pocket 15*a* and one or more matching dovetail keys 34*a* (FIG. 36) on the sides of each plug unit E.

A pair of positioning shoulders 15*g* on the longitudinal walls of the housing pocket 15*a* determines the insertion position of the plug units E by engaging the end faces of the dovetail keys 34*a*. Unequally sized dovetail grooves 15*o* on the two longitudinal walls of the housing pocket 15*a* and matchingly unequal dovetail keys 34*a* on the plug units E preclude the accidental insertion of a plug unit E in the wrong orientation.

Figure 31:
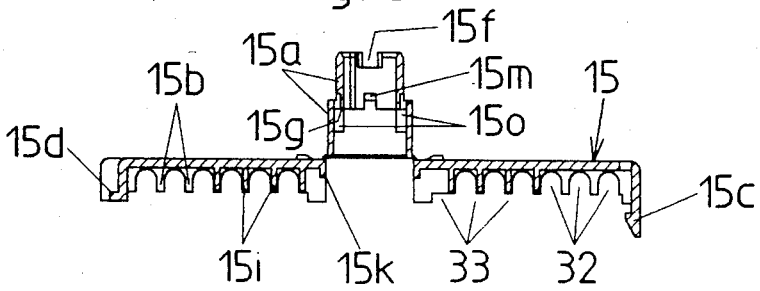
FIG. 31 is a transverse cross section through the connector housing, taken along line XXXI—XXXI of FIG. 27.
Figure 32:
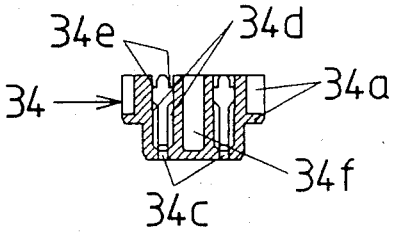
FIG. 32 shows, at an enlarged scale and cross-sectioned along line XXXII—XXXII of FIG. 38, a contact post housing for a short plug unit of the multi-pin plug connector.
Figure 33:
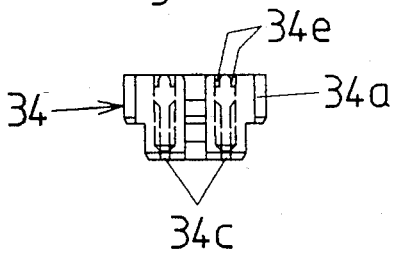
FIG. 33 shows the contact post housing of FIG. 32 in a corresponding end view.
Figure 34:
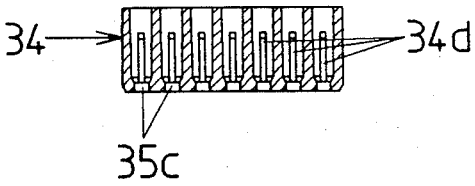
FIG. 34 shows the contact post housing in a longitudinal cross section taken along line XXXIV—XXXIV of FIG. 38.

Following insertion of the plug units E into the pocket 15*a*, the two shell halves of the connector housing 15 can be closed by pivoting them about their bending hinges 15*p*, with the result that inwardly protruding retaining shoulders 15*k* on the two shell halves engage edges on the back sides of the plug units E, thereby clamping the latter against the positioning shoulders 15*g* of the housing pocket 15*a* (FIGS. 9 and 31).

Figure 3:
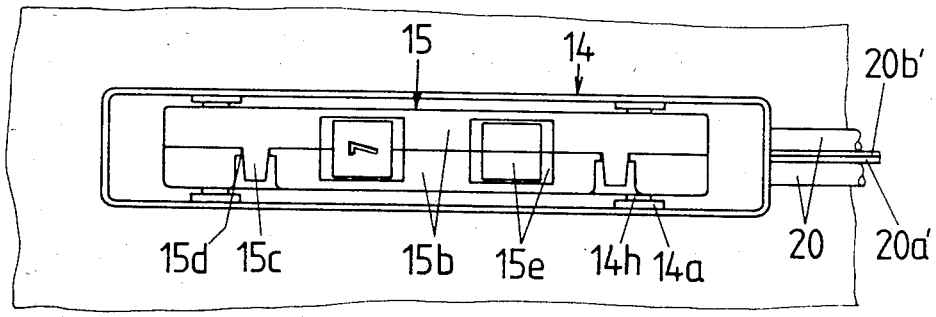
FIG. 3 shows the multi-pin plug connector of FIG. 2 in a plan view.
Figure 5:
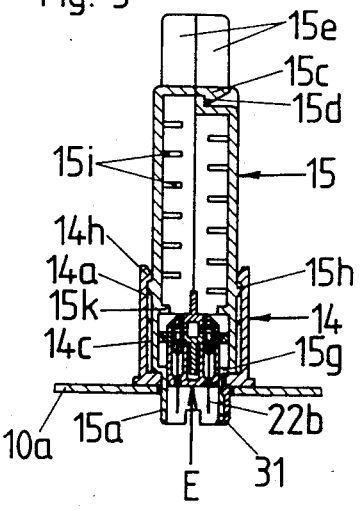
FIG. 5 is a transverse cross section through the plug connector of FIG. 2, taken along line V—V thereof, and likewise without the multi-conductor cables.

In the closed position of the connector housing 15, the two shell halves are held together by means of flexible locking noses 15*c* on the distal edge of one shell half which engage matching locking recesses 15*d* on the distal edge of the other shell half (FIGS. 3, 5 and 30). The two shell halves are centered in relation to each other by means of several centering pins 15*t* in one shell half engaging centering bores 15*n* in the other shell half (FIG. 30).

Any plug unit E and its attached multi-conductor cable, or cables, can be removed from the plug connector assembly by simply opening the shell halves of the connector housing 15 and by sliding the plug unit out of the housing pocket 15*a*, without thereby disturbing the other plug units and their attached cables.

It follows that, by connecting each ribbon cable 20' to a separate plug unit E, it is possible to effortlessly remove or replace the entire cable, together with the attached plug unit, without the need for breaking the electrical connections between the conductors of the cable and the contact pins 22*b* of the plug unit E. In the case of round cables, which normally have fewer conductors, it may be advantageous to group two or more cables with a single small plug unit.

The component parts of a typical plug unit E are shown in FIGS. 32 through 47. Each plug unit consists of four elements: a contact post housing 34, shown in FIGS. 32 through 38, an inner clamping member 35, shown in FIGS. 39 through 42, and outer clamping member 36, shown in FIGS. 43 through 47, and a series of metallic contact posts 22, shown in FIGS. 6 through 9 and 19. A novel structure of such a contact post and a novel method of manufacture are disclosed and claimed in my copending U.S. patent application, Ser. No. 607,127 filed May 4, 1984.

Figure 20:
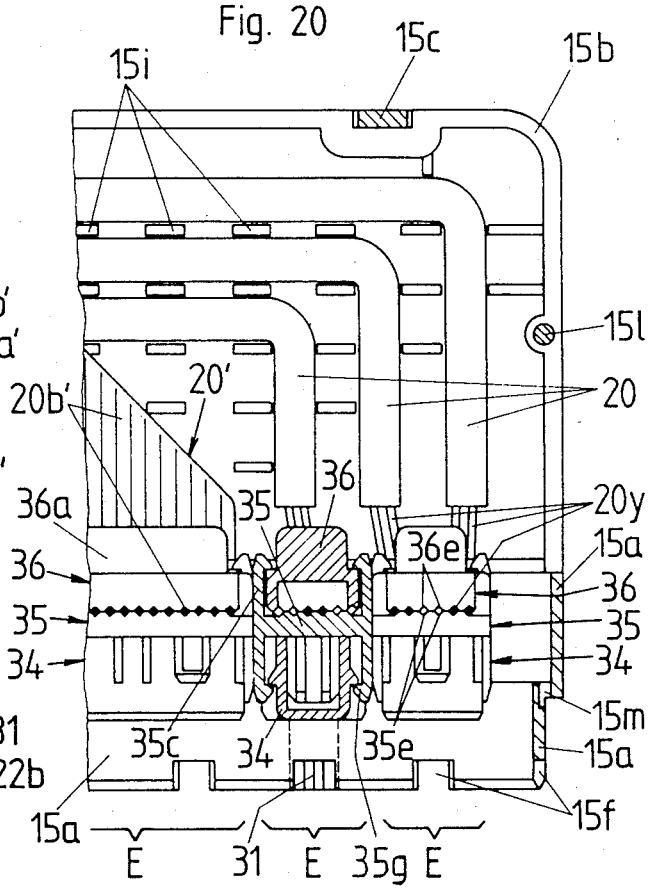
FIG. 20 shows a front portion of the multi-pin plug connector of FIG. 19 in a longitudinal elevational cross section.
Figure 35:
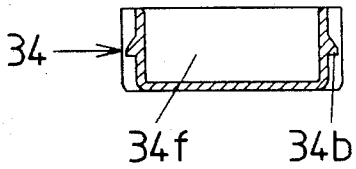
FIG. 35 shows the contact post housing in a longitudinal cross section taken along line XXXV—XXXV of FIG. 38.
Figure 40:
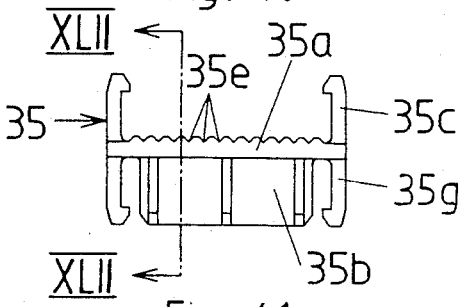
FIG. 40 shows the inner clamping member of FIG. 39 in an elevational view.
Figure 41:
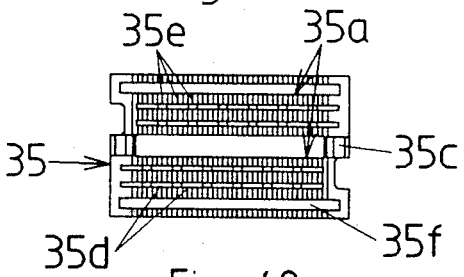
FIG. 41 shows the inner clamping member of FIGS. 39–40 in a top plan view.
Figure 42:
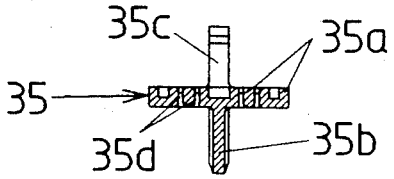
FIG. 42 shows the inner clamping member of FIGS. 39–41 in a transverse cross section taken along line XLII—XLII of FIG. 40.
Figure 44:
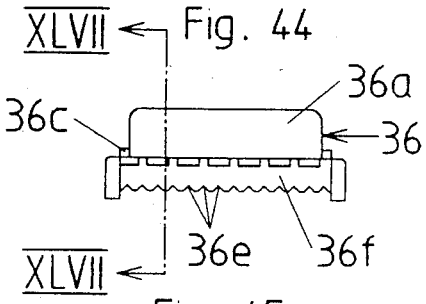
FIG. 44 shows the outer clamping member of FIG. 43 in an elevational view.
Figure 45:
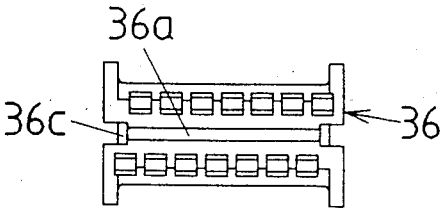
FIG. 45 shows the outer clamping member of FIGS. 43–44 in a top plan view.
Figure 46:
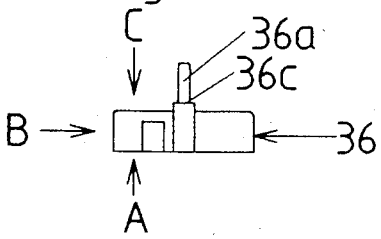
FIG. 46 shows the outer clamping member or FIGS. 43–45 in an elevational end view.
Figure 47:
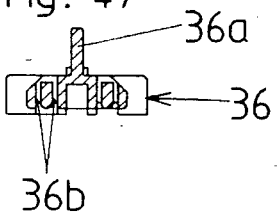
FIG. 47 shows the outer clamping member of FIGS. 43–46 in a transverse cross section taken along line XLVII—XLVII of FIG. 44.

In the assembled condition of a plug unit E (FIG. 20), the strands 20*y* of a multi-conductor cable 20 or 20' are held in parallel alignment and at a regular transverse spacing in positioning grooves 35*e* and 36*e* of the inner and outer clamping members 35 and 36, respectively, as a pair of outwardly extending flexible retaining hooks 35*c* on the extremities the inner clamping member 35 engages corresponding retaining noses 36*c* on the extremities of the outer clamping member 36 (FIGS. 20, 40 and 44). A pair of inwardly extending flexible retaining hooks 35*g* on the extremities of the inner clamping member 35 cooperate in a similar fashion with retaining noses 34*b* of the contact post housing 34 to attach the two clamping members to the housing (FIGS. 20, 35 and 40).

The assembly of a plug unit E and the establishment of the necessary electrical connection between each conductor and a contact post 22 involves first the snap-action attachment of the inner and outer clamping members 35 and 36 to the extremities of the insulated conductor strands 20*y*. The upstanding flexible retaining hooks 35*c* of the inner clamping member thereby provide guidance in cooperation with matching guide grooves in the end faces of the outer clamping member 36, prior to latching onto the retaining noses 36*c* of the latter (FIGS. 20 and 44).

In the case of a ribbon cable, the spacing between its conductor strands 20*y'* corresponds to the spacing of the positioning grooves 35*e* and 36*e*, and there is therefore no need to separate the conductor strands. In the case of round multi-conductor cables, it is necessary to expose an end portion of each conductor strands 20*y* by removing a length portion of the cable sheath. The strands 20*y* are then positioned side-by-side on the groove bed 35*a* of the inner clamping member 35, the correct alignment and spacing being established by the cooperating positioning grooves 35*e* and 36*e* of the inner and outer clamping members 35 and 36, respectively.

In order to improve the clamping effect of the two clamping members 35 and 36 on the conductor strands 20*y* or 20*y'*, their positioning grooves 35*e* and 36*e* have a V-shaped cross section, giving the groove beds 35*a* and 36*f* of the clamping members a sawtooth-shaped profile. The depth of the positioning grooves 35*e* and 36*e* is such that the combined profile of the two groove beds, in the clamped position, provides sufficient space for the webs between the conductor strands of a ribbon cable. The resultant concentration of the clamping pressure in four points on the circumference of the conductor strands improves the strand-holding action, by producing a localized deformation of the conductor insulation.

The central reinforcing ribs 35*b* and 36*a* on the backs of the two clamping members 35 and 36 stiffen the latter to such an extent that, even in the case of a long plug unit, the middle portions of the clamping members exert some clamping pressure on the conductor strands. It should be noted that long plug units are normally only employed in conjunction with ribbon-type multi-conductor cables.

The contact post housing 34 has two rows of pin slots 34*c* extending through its body at twice the longitudinal spacing of the positioning grooves and of the conductor strands, each pin slot holding a metallic contact post 22 with a outwardly extending contact pin 22*b*. Each contact post 22 also has an inwardly protruding length portion with dual contact knives 22*a*.

The inner and outer clamping members 35 and 36 have on opposite sides of their longitudinal center plane two dual rows of guide slits 35*d* and 36*b*, respectively. The spacing of these guide slits corresponds to the longitudinal spacing of the pin slots 34*c* in the contact post housing 34. The guide slits 35*d* and 36*b* are so arranged that they intersect every second positioning groove 35*e* and 36*e* in the groove beds 35*a* and 36*f* of the two clamping members. In addition, the dual rows of guide slits 35*d* and 36*b* on one side of the two clamping members are longitudinally offset by one-half their longitudinal spacing from those on the other side, so that successive positioning grooves 35*e* and 36*e* of the two clamping members are alternatingly intersected by dual guide slits 35*d* and 36*b* on opposite sides of the clamping members 35 and 36, respectively.

When the preassembled inner and outer clamping members 35 and 36 are brought into engagement with the contact post housing 34, the dual contact knives 22*a* of the metallic contact posts 22 penetrate the dual guide slits 35*d* and 36*b* of the two clamping members 35 and 36, thereby also penetrating and partially displacing the insulation of the conductor strands 20*y* or 20*y'* which occupy the positioning grooves 35*e* and 36*e* of the clamping members. In the process, the dual contact knives 22*a* establish an electrical connection between the conductive wires of the multi-conductor cable, or cables, held by the clamping members 35 and 36 and the contact pins 22*b*. As the dual contact knives 22*a* advance into the guide slits of the outer clamping member 36, they are further guided and at the same time forcibly closed against the wires of the conductor strands (FIG. 6).

The engagement of the two clamping members 35 and 36 against the contact post housing 34 thus automatically establishes permanent and secure electrical connections between the conductors of the cable and the contact pins 22*b* of the plug unit E. The engagement movement is guided in the transverse sense by a central reinforcing rib of the inner clamping member 35 which engages a matching central slot 34*f* of the contact post housing 34. Guidance in the longitudinal sense is provided by the inwardly extending retaining hooks 35*g* of the clamping member 35 which engage guide grooves in the end faces of the housing 34. The engaged position is maintained by the retaining hooks 35*g* latching onto retaining noses 34*b* in said guide grooves (FIGS. 20 and 35).

The above-described plug unit E thus lends itself ideally for mass production, while requiring minimal skills for its assembly: Following the insertion of two banks of contact posts into the contact post housing, the injection-molded clamping members and contact post housing are forcibly snapped together, in the process automatically establishing the necessary electrical connections.

Finally, the assembled plug units E are inserted into the pocket 15*a* of the connector housing, the attached multi-conductor cables are reoriented inside the shell halves of the housing in the direction of the entry aperture O, and the connector housing is closed and snapped shut.

It will be noted that the plug connector of the invention is assembled and electrically connected to variously constituted multi-conductor cables without employing any screws, rivets, adhesive joints, or solder. While special tools may be required to remove and disconnect a multi-conductor cable from its plug unit E—an operation which is not recommended and normally not necessary for servicing—no tools are required to open the plug connector housing and to remove any or all of the plug units E and their attached cables.

A simple mechanical code system assures that each plug connector of the electronic control unit can only be inserted into the contact bar 13 of its assigned circuit board module 12. Such a code system is achieved by attaching to each plug connector a small code clip 31 (FIGS. 21 through 25) in such a way that the location of the code clip 31 on the connector housing represents the code information. A matching code recess 37 on the periphery of the rectangular aperture 38 in the back panel 10*a* of the circuitry cabinet 10 (FIGS. 9 and 48) "reads" the code, blocking the insertion of any plug connector with a code clip in a different location.

Figure 48:
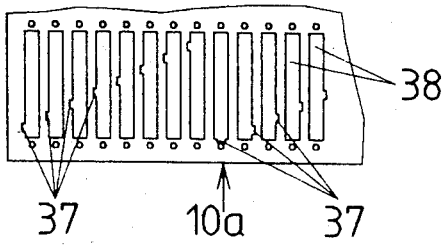
FIG. 48 shows a portion of the back panel of the circuitry cabinet of FIG. 1 with coded apertures for multi-pin plug connector.
Figure 43:
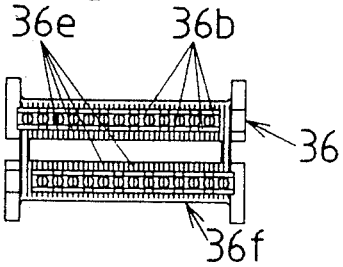
FIG. 43 shows, at a similarly enlarged scale and in a bottom plan view, an outer clamping member for a short plug unit of the multi-pin plug connector.

FIGS. 2, 5, 7 through 9 and 19 through 25 show a code clip attached to a longitudinal wall of the central pocket 15*a* of the connector housing 15. For this purpose, the housing pocket 15*a* has arranged on the outer edge of each of its four sides numbered rectangular dovetail recesses 15*f* (FIG. 2 and 26). By providing eight dovetail recesses on each of the two long sides and one on each of the two short sides of the pocket 15*a*, it is possible to obtain eighteen different positions of the code clip 31, for example. FIG. 48 shows a pattern of code recesses 37 in a row of back panel apertures 38.

In the example herein illustrated and described, each plug connector carries only one code clip 31, and each aperture 38 has only one code recess 37 on its periphery. It should be understood, of course, that it is also possible to use two or more code clips on each plug connector and a corresponding number of matching code recesses in the apertures, if it is desired to have a larger number of different code configurations.

Figure 25:
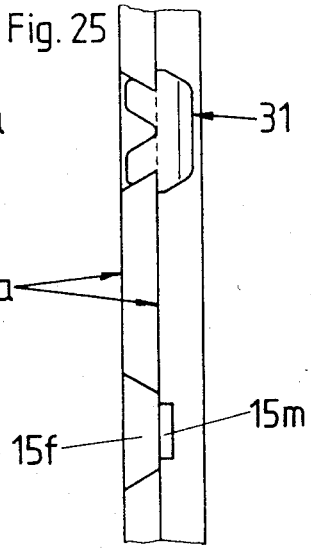
FIG. 25 shows the code clip of FIG. 21 in its mounted position, as part of an end view in the direction of arrow E in FIG. 19.

FIG. 25 shows the shape of a dovetail recess 15*f* in the wall of the housing pocket 15*a* for the attachment of a code clip 31. In a circumferential shoulder of the housing pocket pocket 15*a*, opposite its earlier-mentioned inner positioning shoulder 15*g* and aligned with the dovetail recesses 15*f*, are an equal number of locking recesses 15*m*.

Figure 21:
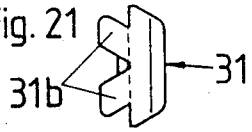
FIG. 21 shows, at a further enlarged scale, a code clip, as seen in the direction of arrow E in FIG. 19.
Figure 22:
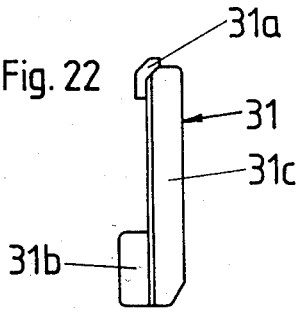
FIG. 22 shows the code clip of FIG. 21 in an end view.
Figure 23:
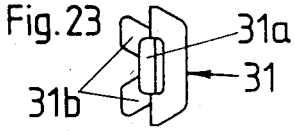
FIG. 23 shows the code clip of FIGS. 21 and 22 as seen in the direction of arrow F in FIG. 19.
Figure 24:
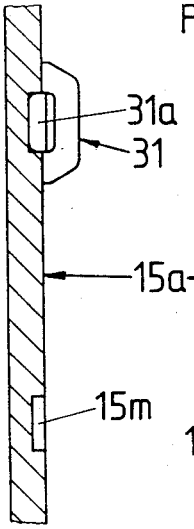
FIG. 24 shows the code clip of FIG. 23 in its mounted position in a cross-sectioned connector housing wall seen in the direction of arrow F in FIG. 19.

The code clip 31 has a central shaft portion 31*c* of generally trapezoidal cross section (FIGS. 21 through 23). On its outer extremity, it has a flexible dovetail key 31*b* which cooperates with the dovetail recess 15*f* of the housing pocket 15*a* to produce a wedge action by which the dovetail key 31*b* is resiliently deformed and held against the wall of the pocket 15*a*, when the code clip 31 is inserted into the dovetail recess 15*f*. On its inner extremity, the clip 31 carries a locking nose 31*a* which, when engaged into the locking recess 15*m* of the housing pocket 15*a*, secures the code clip 31 in place. In this position, an inner end face of the dovetail key 31*b* abuts against the bottom of the dovetail recess 15*f*.

In their engaged position, the plug connectors are initially held in position by the flexible retaining tongues 14*a* of their socket frames 14 which cooperate with a pair of laterally protruding retaining noses 15*h* on each side of the connector housing 15 (FIGS. 7 through 9). The retaining tongues 14*a* provide a detent action, spreading apart when a plug connector is disengaged from the socket bar 13. Two dorsal handle portions 15*e* on each connector housing 15 facilitate the disengagement action.

After engagement of all the plug connectors into their socket bars 13, across their coded apertures 38 in the back panel 10*a*, the plug connectors are positively secured by means of a central locking rail 23 (FIGS. 1, 2 and 8) which engages a central recess 15*e*' between the two dorsal handle portions 15*e* of the plug connectors. The locking rail 23 is similar to the positioning rail 25 for the circuit board modules 12 (FIG. 1). Both rails are removably attached to the walls of the electronic circuitry cabinet 10.

Thus, it is also possible to pull a circuit board modules 12 from the circuitry cabinet, without removing the associated plug connector, by first removing the positioning rail 25 on the forward side of the cabinet 10, and then pulling the module 12 forward, thereby simultaneously disconnecting its socket bars 13 from the data bus 18 and from the plug connector, while both of them are held in place by the back panel 10*a*. This disconnecting operation is shown in FIG. 8. The handle 12*a* on the forward edge of the circuit board module 12 (FIG. 1) facilitates the operation.

It will be noted that, with the exception of the positioning rail 25 and the locking rail 23, which are attached to the cabinet side wall by means of threaded fasteners, no tools are needed to remove and/or access the serviceable components of the electronic control center.

In a modified embodiment of the invention, illustrated in FIGS. 13 through 18, the novel plug connector of the present invention is attached directly to the socket bar 13 of the circuit board module 12 and supported exclusively by the latter, without the intermediary of the back panel 10*a* of the circuitry cabinet 10.

This is accomplished with the aid of an adapter frame 30 taking the place of the back panel 10*a*, the frame 30 being clamped to the socket bar 13 on the circuit board module 12. The adapter frame 30 serves as a support for the positioning frame 14 which is described further above in connection with FIGS. 6 through 9 and 10 through 12, and it also serves as a coded receiving member for the coded connector housing 15.

Figure 14:
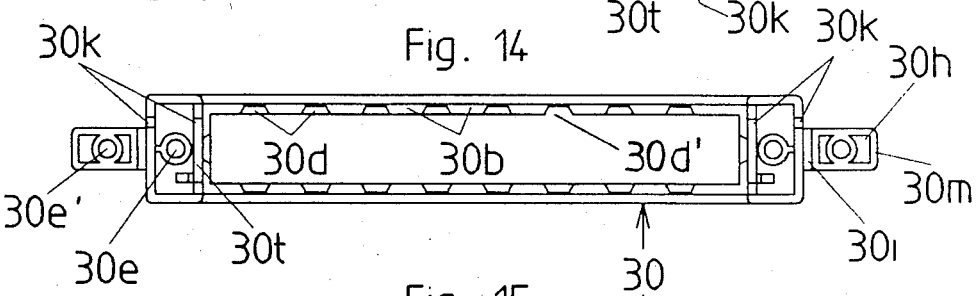
FIG. 14 shows, in a plan view, an adapter frame forming part of the modified plug connector of FIGS. 17 and 18.
Figure 15:
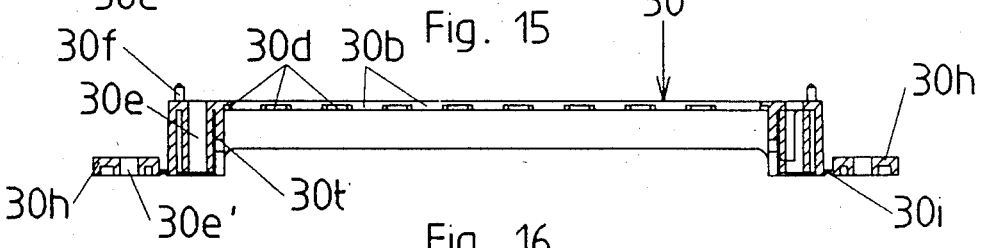
FIG. 15 shows the adapter frame of FIG. 14 in a longitudinal cross section, taken along line XV—XV of FIG. 16.
Figure 16:
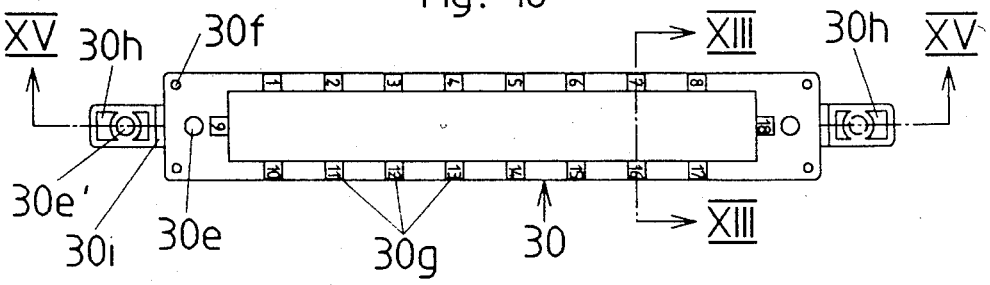
FIG. 16 shows the adapter frame of FIGS. 13–15 in a plan view.
Figure 18:
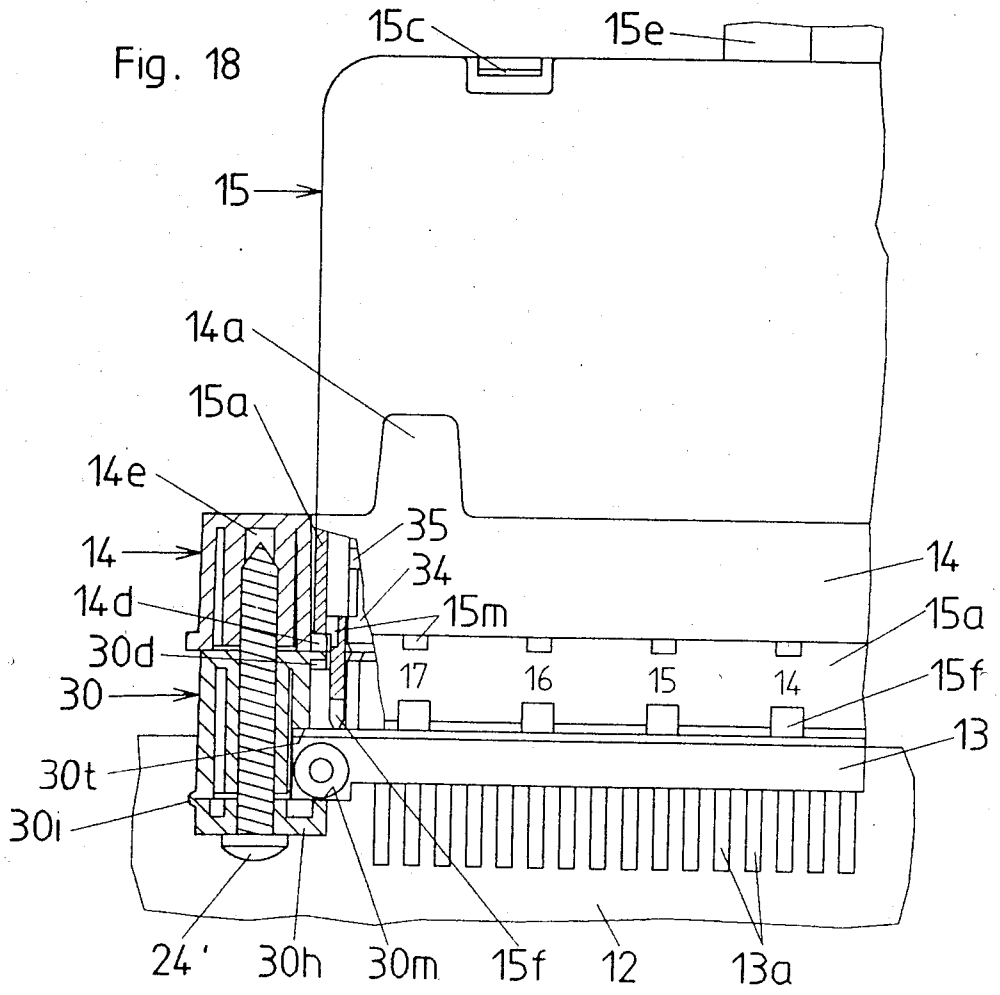
FIG. 18 shows the multi-pin plug connector of FIG. 17 in a partially cross-sectioned elevational front view.

As can be seen in FIGS. 14 through 16, the adapter frame 30 is a rectangular frame with an outline similar to that of the positioning frame 14. Near its extremities, it has two screw holes 30*e* in alignment with the screw holes 14*e* of the frame 14. Linked to the extremities by means of hinge connections 30*i* are two clamping tabs 30*h* with screw holes 30*e*'. After being pivoted inwardly, as shown in FIG. 18, the clamping tabs 30*h* extend behind the extremities of the socket bar 13 with clamping paws 30*m* which cooperate with interior shoulders 30*t* to clamp the socket bar 13.

The two screws 24' which clamp the adapter frame 30 to the socket bar 13 also serve to attach the positioning frame 14 to the adapter frame 30, taking the place of the screws 24 of FIG. 6, lower half. An accurate alignment between the two frames is obtained by means of centering pins 30*f* in the four corners of the adapter frame 30 which engage matching centering holes (not shown) in the positioning frame 14. The tap holes 14*e* of the positioning frame 14 (FIG. 10) have square length portion to facilitate the self-tapping engagement of the screws 24.

For coding purposes, the adapter frame 30 has an inwardly protruding code flange 30*b* with an opening matching the dimensions of the housing pocket 15*a* of the plug connector. The opening of the code flange 30*b* thereby simulates the aperture 38 of the back panel 10*a* (FIG. 48). In order to simplify the establishment of the code in the adapter frame 30, the code flange 30*b* has eighteen knockout recesses 30*d* in alignment with the eighteen dovetail recesses 15*f* of the connector housing 15 and with the eighteen recesses 14*d* of the positioning frame 14. The knockout recesses 30*d* are marked with numbers 30*g*.

The arrangement of knockout recesses in the code flange 30*b* makes it possible to produce the desired code recess 30*b*' in any one of the eighteen position by simply breaking out the knockout portion of the selected recess 30*d*. FIG. 17 shows an engaged plug connector with a code clip 31 reaching through a recess 14*d* of the positioning frame 14 and through a code recess 30*d'* of the adapter frame 30.

The use of an adapter frame 30 in the place of the back panel 10*a* of a circuitry cabinet for positioning and code-reading purposes is advantageous in connection with circuit board modules 12 which have to be located outside the central electronic control unit of the production machine.

Figure 19:
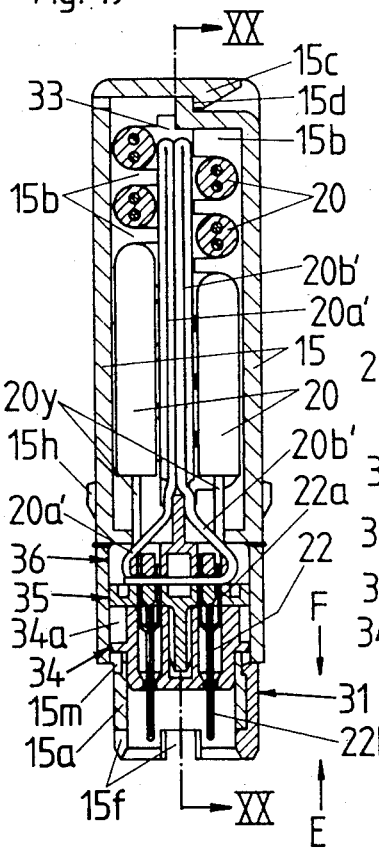
FIG. 19 shows, in an elevational transverse cross section, the multi-pin plug connector of FIGS. 2–9, including a combination of different multi-conductor cables.

FIGS. 2, 19 and 20 show a multi-pin plug connector with a plurality of plug units E having six round cables 20 and two ribbon cables 20' attached thereto. The round cables 20, having only two conductors 20*y* each, are attached to two one-eighth-length plug units E with six positioning grooves 35*e* and 36*e* in their clamping members 35 and 36, respectively.

In view of the close longitudinal spacing of the positioning grooves and the considerably greater diameter of the sheaths of the round cables 20, the attachments of the conductor strands 20*y* to the plug unit E are preferably laid out in such a way that the conductor strands 20*y* of successive cables enter the positioning grooves 35*e*/36*e* alternatingly from opposite sides, as can be seen in FIG. 20. There, this feature is illustrated by showing only those conductor strands 20*y* cross-sectioned in the positioning grooves 35*e*/36*e* which belong to the three round cables 20 in the shell half which remains on the cross-sectioned plug connector assembly.

Accordingly, the conductor strands of the first two cables are shown to be clamped in grooves No. 1, 2, 5 and 6 of the first plug unit E, while the conductor strands of the third cable are clamped in grooves No. 3 and 4 of the second plug unit E. Correspondingly, the first of the three round cables in the opposite shell half has its conductor strands clamped in grooves No. 3 and 4 of the first plug unit, while the second and third cables on that side have their conductor strands clamped in grooves No. 1, 2, 5 and 6 of the second plug unit.

A proximate length portion of the round cables 20 on each side of the plug units E extends transversely to the pin bar assembly formed by the sum of the plug units E, in approximate alignment with the positioning grooves 35*e* and 36*e* of the clamping members 35 and 36. This alignment is maintained by means of a matrix of cable positioning studs 15*i* in the two shell halves of the connector housing 15 (FIG. 30). As can be seen in FIG. 20, the cable positioning studs 15*i* also serve to produce and maintain longitudinally and transversely staggered reorientation bends between the transversely oriented proximate length portions and longitudinally oriented entry portions of the cables 20.

The rectangular dimensions of the cable positioning studs 15*i* are such that the spacing between adjacent studs in either direction is somewhat smaller than the diameter of the round cables 20, and the studs 15*i* have sharp corners with which they tend to bite into the sheaths of the cables 20, especially in the area of their reorientation bends, thereby also providing a effective strain-relief function for the conductor strands.

As can be seen in FIGS. 19 and 30, the longitudinal rows of cable positioning studs 15*i* in the two shell halves are offset from each other by one-half the spacing between rows to align the longitudinal cable length portions with the rounded recesses 32 of the cable entry opening O (FIG. 30). These recesses are likewise narrower than the diameter of the round cables 20 to produce a slight deformation of the inserted cables.

The pivotability of the shell halves of the connector housing 15 about their bending hinges 15*p* assures an effortless and convenient assembly operation, both shell halves being fully accessible for the insertion and bending of a set of round cables.

The two strips 20*a'* and 20*b'* of the ribbon cable 20' may be connected to one or several plug units E. Their conductor strands may enter the plug units from the same side, or from opposite sides, as shown in FIG. 19, for example. The plug units E with attached ribbon cable strips are inserted into the pocket 15*a* of the connector housing 15 following the insertion of the round cables 20. In order to reorient the ribbon strips from their proximate transverse orientation to the longitudinal orientation, they are given a diagonal fold, as shown in FIG. 2. The diagonal folds of the cable strips 20*a'* and 20*b'* are staggered in the longitudinal sense, but not in the transverse sense, so that the cable strips extend through the cable entry aperture O in an overlying relationship.

Numerous advantages of the multi-pin plug connector of the invention are obvious from the foregoing description, among them the need for very few parts, all of them—except for the metallic contact posts—injection-molded, the simplicity of making the electrical connections and assembling the parts and, last but not least, the capability of connecting variably constituted combinations of multi-conductor cables to a standardized socket bar of a circuit board module.

It should be understood, of course, that the foregoing disclosure describes only preferred embodiments of the invention and that it is intended to cover all changes and modifications of these examples of the invention which fall within the scope of the appended claims.

I claim:

1. A multi-pin plug connector system for the selective and joint connection of single and multiple unequally constituted multi-conductor cables of the round type and of the ribbon type to the contact sockets of a standardized multiconductor socket bar, the multi-pin plug connector system, defined hereinafter in an orientation for vertical plugging engagement, comprising in combinations:

a plug connector including a plug connector housing of injection-molded plastic material, the connector housing forming in its lower portion a housing pocket with elongated, generally rectangular upper and lower openings defined by two substantially vertically oriented longitudinal pocket walls with horizontal upper and lower edges and by two substantially vertically oriented transverse pocket walls, the connector housing forming in its upper portion two shell halves which are attached to the upper edges of the longitudinal pocket walls by means of integral bending hinges and pivotable about said bending hinges between an open position and a closed position, the housing pocket being adapted for the selective accommodation and retention therein of a pin bar assembly of standardized horizontal length which is selectively composed of a single full-length plug unit and of a variable number of fractional-length plug units arranged end-to-end and in line with each other;

at least one plug unit arranged in the housing pocket;

a plurality of parallel, vertically oriented and horizontally regularly spaced metallic contact posts arranged in each plug unit, the contact posts having lower end portions in the form of contact pins which protrude downwardly from the plug unit, being engageable into the contact sockets of said socket bar;

a plurality of electrical conductors connected to the contact posts at their upper end portions, the electrical conductos forming part of at least one multi-conductor cable entering the plug connector housing in the area of a joint line formed by its closed shell members; and means for positioning the multi-conductor cable, or cables, respectively, on the inside of the plug connector housing; and wherein the housing pocket has on the inside of its longitudinal pocket walls upwardly facing seating shoulders;

the shell halves have in the vicinity of their bending hinge attachment to the upper edges of said pocket wall retaining shoulders which, in the closed position of the shell halves, face downwardly and protrude laterally inwardly over the longitudinal pocket walls;

the plug unit, or plug units, respectively, are insertable into the housing pocket through its upper opening, when the shell halves are in their open position, and vertically securable in the housing pocket through downward abutment against the seating shoulders of the longitudinal pocket walls and upward abutment against the retaining shoulders of the shell halves; and the plug unit, or plug units, respectively, and the two longitudinal pocket walls form vertically oriented key-and-groove profiles of the dovetail-type which produce a transverse attachment between the plug units and the longitudinal pocket walls.

2. A multi-pin plug connector system as defined in claim 1, wherein the two shell halves define means for locking the shell halves together in their closed position; and the joint line formed by the shell halves in their closed position coincides with a vertical longitudinal plane through the center of the housing pocket.

3. A multi-pin plug connector system as defined in claim 2, wherein the two shell halves of the plug connector housing have each a base wall of which one longitudinal side is joined to the housing pocket by said bending hinge and the remaining circumference is surrounded by a shell end wall; and the end walls of the two shell halves form a cable entry aperture for said multi-conductor cable or cables, respectively, at the joint line formed by the closed shell halves, the cable entry aperture being defined by at least one recess in the end wall of at least one shell half, which recess is open at the joint line, so as to permit the insertion of a cable in the open position of the shell halves.

4. A multi-pin plug connector system as defined in claim 3, wherein the cable entry aperture is defined by a plurality of rounded recesses in the end walls of both shell halves, for the entry of a plurality of round multi-conductor cables into the plug connector housing; and the cable positioning means includes a plurality of upstanding cable positioning studs on the base walls of the two shell halves, at least some of said studs engaging the cables from opposite sides, so as to maintain the cables in a bent configuration while deforming their cable sheaths, the cable positioning studs thereby also serving as a strain relief attachment for the round multi-conductor cables.

5. A multi-pin plug connector system as defined in claim 4, wherein the two shell halves have a generally rectangular outline, their joint line having a horizontal and two vertical sides;

the cable entry aperture is arranged at one of the two vertical sides of the joint line;

the rounded recesses of the cable entry aperture in the shell end walls and the cable positioning studs on the shell base walls are so arranged that a plurality of round multiconductor cables are positionable on each of the two shell halves in such a way that parallel longitudinal cable portions lead horizontally into the plug connector housing to right-angle cable bends and transverse cable portions lead from the cable bends to the associated plug units of the pin bar assembly, cables with transverse length portions located further away from the cable entry aperture having their longitudinal length portions positioning further away from the housing pocket; and the cable entry aperture has its rounded recesses arranged at such a distance from the joint line of the shell halves that there is room for the entry of at least one multi-conductor ribbon cable centrally between the longitudinal length portions of the round multi-conductor cables which enter the plug connector housing on opposite sides of the joint line.

6. A multi-pin plug connector system as defined in claim 5, wherein the cable positioning studs on the base walls of the two shell halves form horizontal rows which are so arranged that the stud rows of one shell half are offset from the stud rows of the other shell half, with the result that, in the closed position of the shelf halves, the positioning studs of one shell half extend against the horizontal length portions of the round cables in the other shell half, thereby securing them in their place.

7. A multi-pin plug connector system as defined in claim 2, wherein the locking means of the two shell halves are in the form of at least one closure latch which extends from one shell half into engagement with a matching locking recess in the other shell half, the closure latch being an integral, partially flexible extension of an end wall of the shell half with a leading taper at its free extremity, so as to permit a snap engagement of the closure latch into the locking recess and a release of the locking means through the forcible flexing of the closure latch away from the locking recess.

8. A multi-pin plug connector system as defined in claim 2, wherein the two shell halves include shell centering means in the form of protruding centering pins in one shell half and matching centering bores in the other shell half engaging each other in the closes position of the shell halves.

9. A multi-pin plug connector system as defined in claim 2, wherein each of the two shell halves of the plug connector housing has a substantially flat base wall of generally rectangular outline, one longitudinal side of the base wall being joined to the housing pocket by said bending hinge and the other three sides being surrounded by a shell end wall;

the base wall and the end walls of the shell halves are so arranged that, in the closed position of the shell halves, the base walls are substantially aligned with the two longitudinal pocket walls and the end walls of the two shell halves are aligned with each other on opposite sides of said joint line; and the walls of the housing pocket and of the integrally attached shell halves are so arranged that the plug connector housing is injection-moldable with horizontally aligned open shell halves.

10. A multi-pin plug connector system as defined in claim 1, wherein the dovetail-shaped key-and-groove configurations on the two longitudinal pocket walls are of unequal size, so as to permit insertion of the plug units into the housing pocket in only one orientation.

11. A multi-pin plug connector system as defined in claim 1, wherein the vertical dovetail keys are arranged on the plug units and the cooperating vertical dovetail grooves are arranged on the inner side of the longitudinal pocket walls.

12. A multi-pin plug connector system as defined in claim 1, wherein each plug unit includes:

an elongated block-shaped horizontal contact post housing of injection-molded plastic material, the housing having opposite upper and lower longitudinal sides;

two rows of contact post apertures extending vertically through the contact post housing, the contact post apertures being spaced at a regular longitudinal pitch;

an elongated horizontal inner clamping member of injection-molded plastic material defining on its upper side an upwardly facing groove bed with a row of regularly spaced, horizontally transversely oriented conductor positioning grooves;

a similar horizontal outer clamping member defining on its lower side a matching downwardly facing groove bed with a row of conductor positioning grooves;

first latching means operable to join the outer clamping member to the inner clamping member, to form a clamping assembly in which the groove beds of the two clamping members cooperate to clamp between them the conductors of said multiconductor cable, or cables, respectively, each conductor being held between a pair of vertically aligned conductor positioning grooves of the two clamping members; and second latching means operable to join the clamping assembly to the contact post housing in such a way that the lower side of its inner clamping member adjoins the upper side of the housing.

13. A multi-pin plug connector system as defined in claim 12, wherein the contact posts are engaged and seated in the contact post apertures of the contact post housing;

the contact posts have upper end portions forming vertical yoke-shaped contact blades which reach upwardly into aligned guide slots of the inner and outer clamping members, the contact blades having vertically oriented central blade slots which are open at the upper extremity of the contact blades where they form an entry taper; and the contact blades of the contact posts penetrate and displace the insulation of the conductors clamped in the conductor positioning grooves of the clamping assembly on both sides of their conductive strands, the conductors being wedged into the contact slots of the contact blades to establish electrical connections therebetween.

14. A multi-pin plug connector system as defined in claim 12, wherein the conductor positioning grooves of the inner and outer clamping members have substantially identical V-shaped cross-sectional outlines, the cross-sectional outline of cooperating pairs of grooves in the clamping assembly being substantially square.

15. A multi-pin plug connector system as defined in claim 1, wherein the fractional-length plug units are selectively equal to one-eighth, one-quarter and one-half of the length of a full-length plug unit; and the fractional-length plug units are so arranged in the housing pocket that the nearest contact posts of two adjacent plug units are spaced at a horizontal distance which is equal to twice the longitudinal spacing between the contact posts within each plug unit.

16. A multi-pin plug connector system as defined in claim 15, wherein each plug units carries two parallel rows of vertical contact posts;

a full-length plug unit has thirty-two contact post in each row;

a one-half-length plug unit has fifteen contact posts in each row;

a one-quarter-length plug unit has seven contact posts in each row; and a one-eighth-length plug unit has three contact posts in each row.

17. A multi-pin plug connector system as defined in claim 1, further comprising:

a socket frame surrounding the socket bar, including means for mounting the socket frame in a solidary relationship with the socket bar; and detent means defined between the plug connector housing and the socket frame for the yielding retention of the connector housing against the socket frame in the engaged position.

18. A multi-pin plug connector system as defined in claim 17, wherein the housing pocket is defined by two substantially vertically oriented longitudinal pocket walls and two substantially vertically oriented transverse pocket walls, said walls giving the housing pocket a substantially rectangular outline;

the socket frame has a similar rectangular outline of larger dimensions, extending above the socket bar and surrounding at least a portion of the housing pocket of the connector housing, when the plug connector is engaged in the socket bar; and the detent means includes a plurality of elastic retaining tongues which are attached to the socket frame with inwardly projecting detent noses and cooperating retaining noses on at least the longitudinal outer sides of the housing pocket.

19. A multi-pin plug connector system as defined in claim 17, wherein the means for mounting the socket frame includes a horizontal back panel, the socket frame being attached to the upper side of the back panel and at least one socket bar being attached to the lower side of the back panel;

the back panel has a generally rectangular back panel aperture which is vertically aligned with, and smaller than, the inner width of the socket frame, at least a lower portion of the housing pocket being insertable into the back panel aperture;

the plug connector housing and the back panel aperture define engagement code means for keying the plug connector to a single one out of a number of otherwise identical socket bars;

the engagement code means includes a code clip which is attached to the outer side of the housing pocket in one of a number of distinct code locations on the outer circumference of the housing pocket, the code clip protruding laterally from the pocket wall; and the engagement code means further includes a code recess on the circumference of the back panel aperture, the location of the code recess matching the location of the protruding code clip on the housing pocket.

20. A multi-pin plug connector system as defined in claim 19, wherein the vertical walls of the housing pocket have a downwardly open dovetail recess at each of said distinct code locations;

the code clip includes a dovetail key matching said dovetail recess for frictional engagement thereinto; and the code clip has at it upper extremity a locking nose adapted to yieldingly snap into a vertical recess in an overhanging wall portion of the housing pocket.

21. A multi-pin plug connector system as defined in claim 17, wherein the means for mounting the socket frame includes an adapter frame of a rectangular outline which substantially matches the outline of the socket frame, the adapter frame being clampable to the lower side of the socket frame, while surrounding a socket bar and including means for attaching the socket bar to the adapter frame;

the adapter frame has on its inside an inwardly protruding code flange defining a generally rectangular adapter aperture which is vertically aligned with, and smaller than, the inner width of the socket frame, at least a lower portion of the housing pocket being insertable into the adapter aperture;

the plug connector housing and the adapter aperture define engagement code means for keying the plug connector to a single one out of a number of otherwise identical socket bars;

the engagement code means includes a code clip which is attached to the outer side of the housing pocket in one of a number of distinct code locations on the outer circumference of the housing pocket, the code clip protruding laterally from the pocket wall; and the engagement code means further includes a code recess on the circumference of the adapter aperture, the location of the code recess matching the location of the protruding code clip on the housing pocket.

22. A multi-pin plug connector system as defined in claim 21, wherein the vertical walls of the housing pocket have a downwardly open dovetail recess at each of said distinct code locations;

the code clip includes a dovetail key matching said dovetail recess for frictional engagement thereinto; and the code clip has at it upper extremity a locking nose adapted to yieldingly snap into a vertical recess in an overhanging wall portion of the housing pocket.

23. A multi-pin plug connector system as defined in claim 21, wherein the code flange of the adapter frame includes at each of said distinct code locations a knockout recess in the form of a weakened portion of the code flange which is adapted to be broken away from the code flange to create a code recess in alignment with the code clip on the housing pocket of the plug connector housing.

* * * * *